US005167571A

United States Patent [19]

Waller

[11] Patent Number: 5,167,571

[45] Date of Patent: Dec. 1, 1992

[54] COIN HANDLING MACHINE

[75] Inventor: Daniel J. Waller, Reno, Nev.

[73] Assignee: International Game Technology, Reno, Nev.

[21] Appl. No.: 699,861

[22] Filed: May 14, 1991

Related U.S. Application Data

[63] Continuation-in-part of Ser. No. 683,974, Apr. 11, 1991, abandoned.

[51] Int. Cl.[5] ..... G07D 1/00

[52] U.S. Cl. ..... 453/29; 453/57; 453/33

[58] Field of Search ..... 453/30, 29, 32-35, 453/57

[56] References Cited

U.S. PATENT DOCUMENTS

| | | | |
|---|---|---|---|
| 3,396,737 | 8/1968 | Picullo | 453/57 X |
| 3,422,824 | 1/1969 | Persson | 453/57 X |
| 3,698,537 | 10/1972 | Black et al. | 453/57 |
| 4,135,529 | 1/1979 | Onoe et al. | 453/32 X |
| 4,557,282 | 12/1985 | Childers et al. | 453/30 X |
| 4,561,457 | 12/1985 | Sasaki | 453/34 X |
| 4,589,433 | 5/1986 | Abe | 453/57 |
| 5,066,261 | 11/1991 | Parham | 453/57 |
| 5,074,824 | 12/1991 | Suris | 453/57 |

FOREIGN PATENT DOCUMENTS

| | | | |
|---|---|---|---|
| 2231720 | 1/1973 | Fed. Rep. of Germany | 453/57 |
| 1-274293 | 11/1989 | Japan | 453/57 |
| 1445089 | 8/1976 | United Kingdom | 453/33 |
| 2185341 | 7/1987 | United Kingdom | 453/57 |

*Primary Examiner*—Michael S. Huppert
*Assistant Examiner*—William M. Hienz
*Attorney, Agent, or Firm*—Townsend and Townsend

[57] ABSTRACT

An improved coin handling machine of the type having a rotating coin bowl and coin stripper is presented which allows a coin to be stabilized prior to exiting the machine, reducing jamming of the machine and subsequent maintenance. Improvements include the provision of a set of coin pushers on the underside of the drum wheel disk, a coin guide for helping the coins remain in their respective coin receiving spaces and one or more pressure pads placed strategically above the coin stripper for discharging the coins out of the machine, the pressure pad(s) preventing the coins from gravitationally dropping over the coin stripper as the coins move toward the coin exit chute.

17 Claims, 5 Drawing Sheets

COIN HANDLING MACHINE

CROSS-REFERENCE TO RELATED APPLICATIONS

This application is a continuation-in-part of application Ser. No. 07/683,974 by the same inventor and assignee herein, filed Apr. 11, 1991, now abandoned.

BACKGROUND OF THE INVENTION

This invention relates generally to coin handling machines, and specifically to coin handling machines with rotating coin bowls.

Referring to FIG. 1, shown is a plan view of a conventional coin handling machine having a coin bowl 10 which may be at an angle to horizontal and is typically rotated. Coins are typically loaded into the machine through a fixed coin hopper 20 and fall gravitationally, or are pushed into the coin bowl. (Coin 12*a* is shown leaving the coin bowl, while coin 12*b* is shown lodged in a coin receiving space.) The coins form a tumbling coin mass and coin lifters 14 attached to a rotating drum wheel disk 16 help direct coins through coin receiving holes 17 of the drum wheel disk when the coin level is low and into the space between the back side of the drum wheel disk and a stationary surface which is parallel and spaced from the drum wheel disk. The drum wheel disk forms the bottom of the coin bowl 10 and carries ejector pins 19 on its back side which direct the coins to an exit chute 18. A coin stripper 22, mounted on a stationary back surface 24 and positioned behind the drum wheel disk, engages an edge of a coin as it is pushed along by the ejector pins and directs the coins into chute 18 and out of the machine. The coins impinge on a coin stripper edge 22*a*, which is usually a hard steel or plastic surface. Ejector pins 19 exert forces on the coins which act both parallel and perpendicular to the coin stripper edge. A hub 25 on the back side of drum wheel disk 16 may also be included to help guide the flow of coins toward coin holes 17.

Other coin handling machines which operate along the lines discussed above are known. U.S. Pat. No. Reissue No. 28,557 shows a disk dispensing apparatus. U.S. Pat. No. 902,067 (Froberg) discloses a rotating coin receiver designed to receive a mass of coins, preferably inclined so that the coins slide toward a lower portion of the coin receiver, where openings allow the coins to be driven out of the receiver by reciprocating slides. Similarly, U.S. Pat. No. 918,273 (Brewster) discloses a coin counter having a plurality of coin separating disks which rotate around a spindle and in which a hopper rotates via a hand wheel crank. U.S. Pat. No. 1,080,533 (Bach) discloses a rotating coin hopper, but coins are guided only by rotation of the hopper. Other relevant patents include U.S. Pat. No. 1,095,981, which shows a lifting plate for discharging coins; U.S. Pat. No. 3,757,805, which shows an annular ring which defines an adjustable space for coins of different thicknesses; U.S. Pat. Nos. 4,557,282 and 4,620,559, which disclose rotating coin hoppers; and U.S. Pat. No. 4,570,655 which shows coin guides.

Most prior art coin handling machines suffer frequent failures which take them out of service. Failures are typically due to a coin wedging against a stationary coin bowl ring or other surface which is stationary or relatively slower moving. Other failures typically occur because of improper or lack of adequate agitation of the coin mass by the rotating drum wheel disk and the coin lifters attached to the drum wheel disk, inadequate guidance of the coins as they are moved toward the discharge chute, or the accumulation of "coin dust" in these machines, with no apparent way of removing it.

SUMMARY OF THE INVENTION

In accordance with the present invention, a coin handling machine is provided for sequentially dispensing individual coins from a coin mass. The machine includes a frame, a stationary back plate assembly mounted to the frame and having a face which is angularly inclined relative to the vertical, and a disk parallel to and spaced from the stationary back plate assembly for defining a generally annular coin moving space between the disk and the stationary back plate assembly. The disk generally includes a plurality of circumferentially spaced coin-receiving holes of a diameter sufficient to permit passage of the coin from a side of the disk facing away from the stationary back plate assembly into the coin moving space. One novel feature is a set of coin pushers associated with each coin hole, the pushers being radially spaced and the stationary back plate assembly including a plurality of spaced-apart circular grooves positioned and formed to coincide with the positions of the coin pushers. The coin pushers extend from the disk into the associated grooves of the back plate, with the leading edges of the pushers in the direction of rotation of the disk trailing the associated coin hole in the disk. As the pushers move coins along an arcuate path through the space as the disk is rotated, a stripper means traversing the arcuate path intercepts the coins, thereafter moving them transversely to the direction of rotation of the disk from the space to a coin discharge area which is beyond a periphery of the disk. Preferred embodiments include those wherein the radially innermost of each set of pushers is closest to the associated coin hole in the disk and the radially outermost pusher is furthest removed from the associated coin hole in the disk so that the forces applied by the pushers to a coin engaged by the stripper means act generally in the direction of the transverse movement of a coin to the discharge area.

Another aspect of the invention includes a pressure pad located proximate to and upstream of the stripper means in the direction of disk rotation, the pressure pad being movably mounted to the stationary back plate assembly and including means for biasing the pressure pad toward the disk which gently presses a coin overlying the pad against the disk to thereby stabilize the coin in the space immediately prior to its engagement by the stripper means.

Further aspects of the invention will become apparent from the description which follows.

DESCRIPTION OF THE PREFERRED EMBODIMENTS

Figure 1:
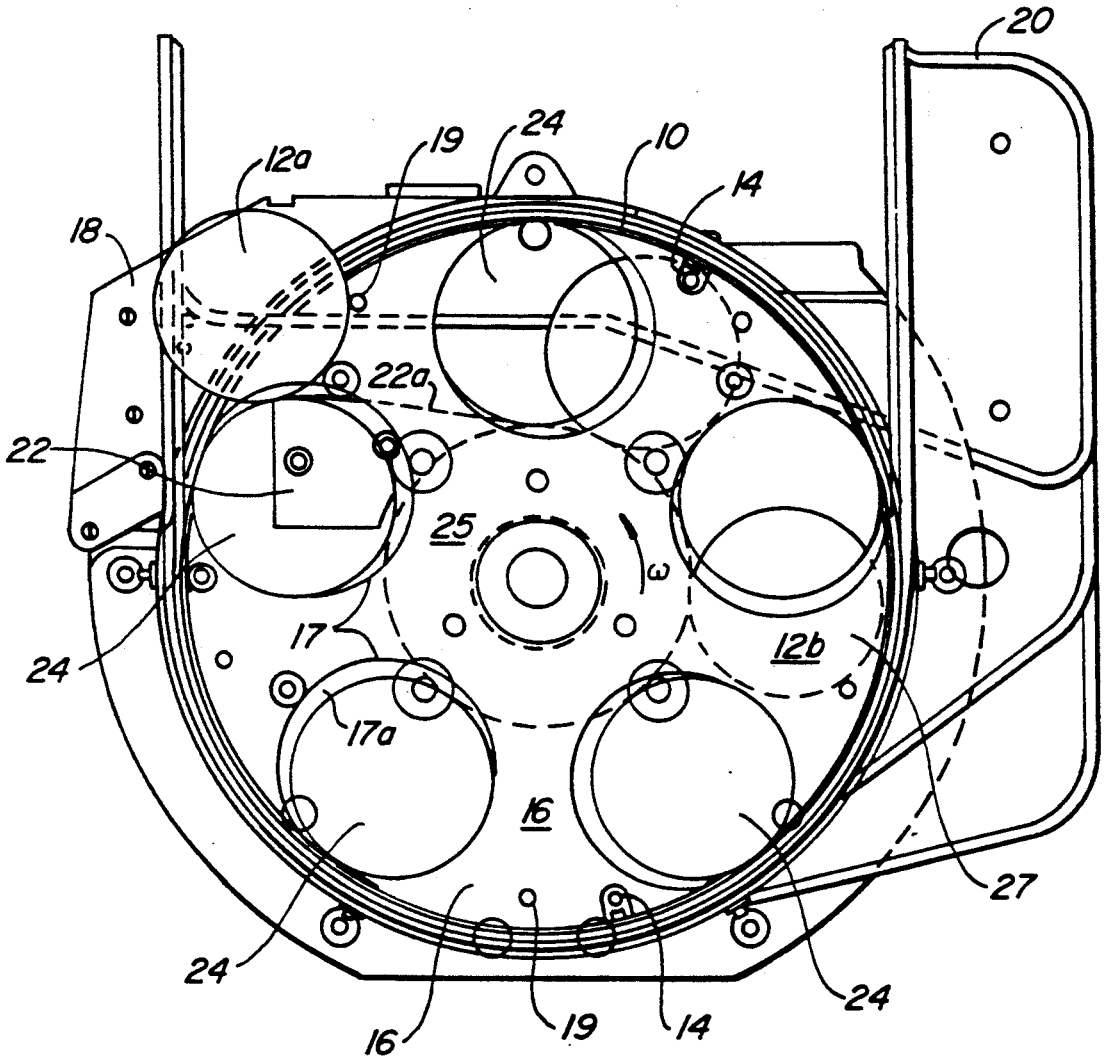
FIG. 1. PRIOR ART
FIG. 1 is a prior art apparatus presented to illustrate the state of the art.
Figure 2:
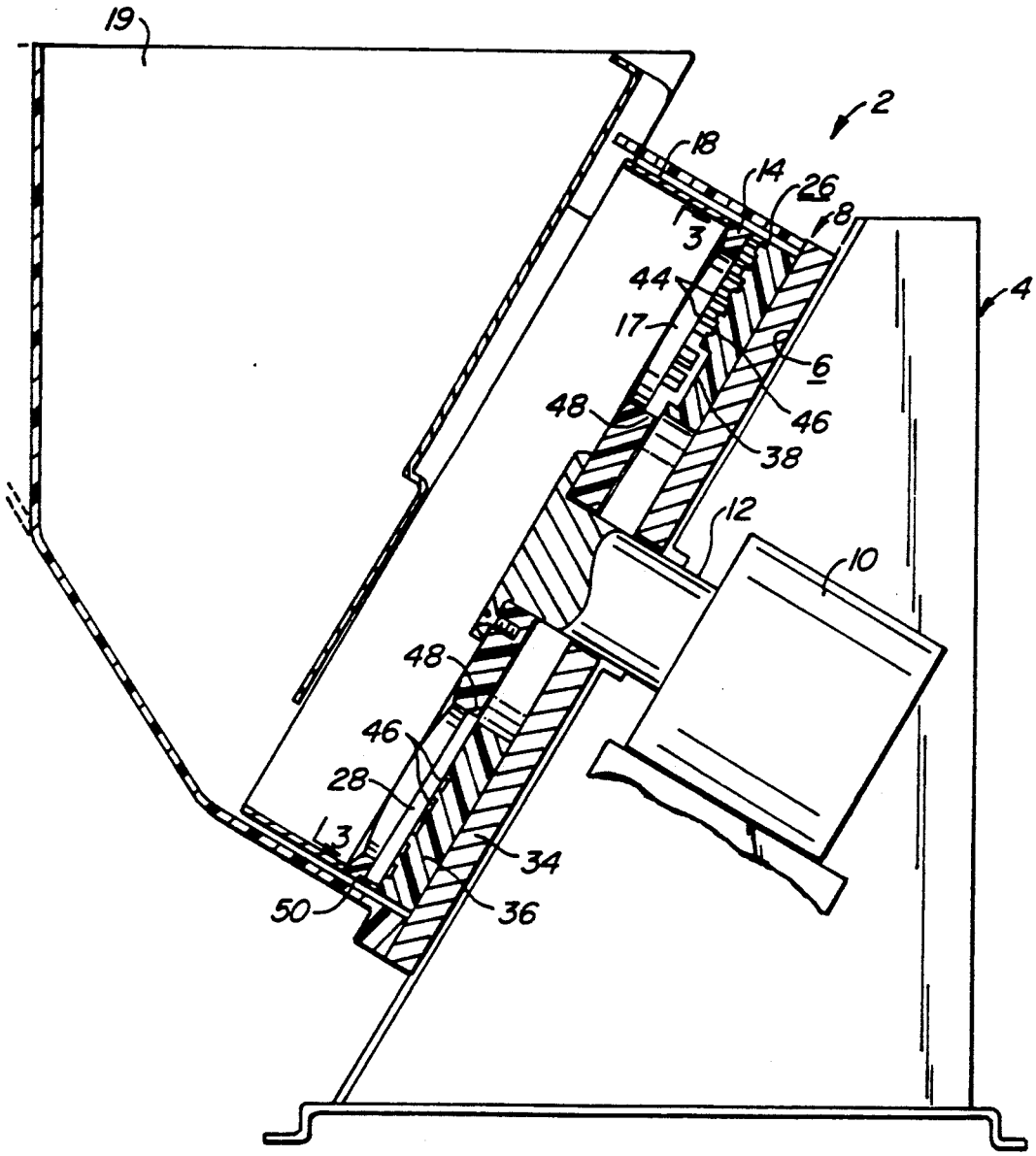
FIG. 2 is a side elevation and section of a coin handling machine constructed in accordance with the present invention.
Figure 3:
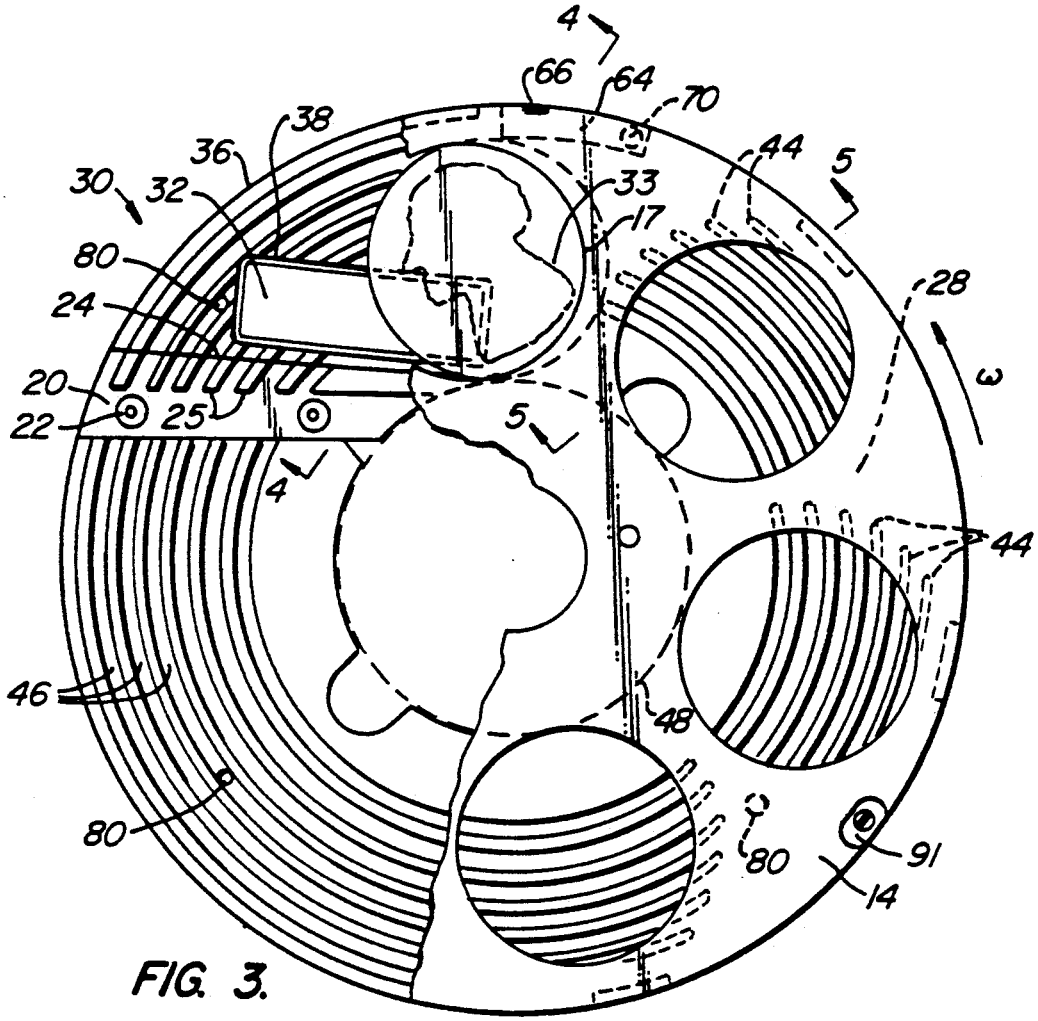
FIG. 3 is an elevation, with parts broken away, of the coin handling machine shown in FIG. 2 and is taken on line 3—3 of FIG. 2.

Referring to FIGS. 2 and 3 (similar reference numerals are used throughout FIGS. 2–8), a coin handling machine 2 constructed in accordance with the present invention generally comprises an upright frame 4 adapted to be supported on a flat surface (not separately shown) which has an inclined face 6 to which a stationary back plate assembly 8 is secured. (As used herein the term "stationary" means not rotating, with axial movement allowable.) A drive motor 10 is mounted to the frame on the side of face 6 opposite from the back plate assembly and it includes a shaft 12 which protrudes through an appropriate bore in the back plate assembly. A drum wheel disk 14, mounted to the free end of the motor shaft for rotation therewith, is spaced from the stationary back plate assembly, as is further discussed below, and includes a central hub 48 and a plurality of circumferentially spaced-apart coin receiving holes 17 of a diameter sufficient to permit passage of the coins being handled by the machine. A cylindrical drum 18 is attached to the disk along its periphery and rotates with the disk when driven by the motor. Cylindrical drum 18 and disk 14 rotate in a counterclockwise fashion as designated by the arrow $\omega$ (FIG. 3), although it will be appreciated by those skilled in the art that clockwise rotation may be used with associated changes in the structure in the coin handling machine. A coin hopper 19, which may be made of molded plastic material, is attached to the back plate assembly, surrounds the disk and the cylinder drum and holds a mass of coins (not shown).

Referring specifically to FIG. 3, this figure shows a section taken along the line 3—3 of FIG. 2. A coin stripper 20 is disposed in a suitably shaped recess of the back plate assembly 8 with threaded bolts 22, for example. The stripper includes a coin stripping edge 24 which protrudes from surface 26 of the back plate assembly, that is, it protrudes into a space 28 between disk 14 and back plate assembly 8. (See FIG. 4, a section taken along the line 4—4 of FIG. 3.) The coin stripping edge extends transversely (but not radially) to the direction of rotation of the disk from the vicinity of disk hub 48 toward the periphery of the back plate assembly and a coin discharge area 30 where coins are introduced into a suitable coin chute (not shown) for delivery to a desired coin pay-out location (not shown).

Figure 4:
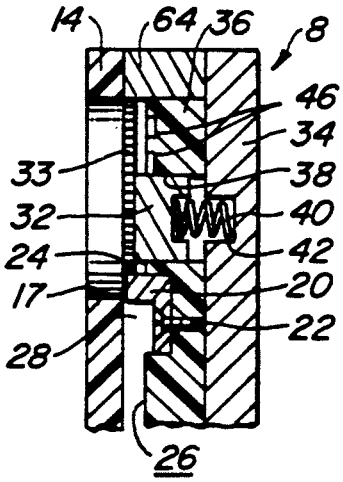
FIG. 4 is a section taken on line 4—4 of FIG. 3, and shows how the pressure pad holds a coin against the back side of the drum wheel disk.
Figure 7:
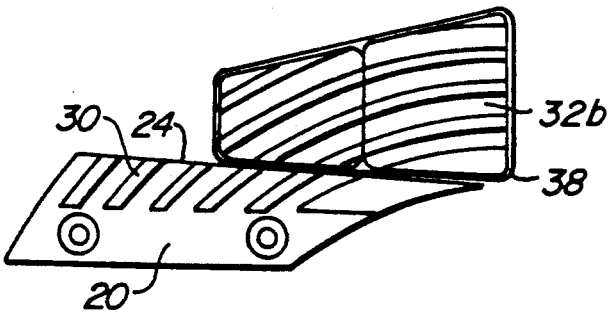
FIG. 7 shows an embodiment of a pressure pad wherein the pad comprises two individual pressure pads.

Just upstream (in the counterclockwise direction of rotation of drum wheel disk 14 of the stripper 20 is a pressure pad 32 which gently biases a coin 33 (shown in FIG. 4) toward the back side of drum wheel disk 14. In the preferred embodiment of the invention, the stationary back plate assembly 8 is formed of a stationary back plate 34 and a stationary ring 36 secured, for example, bolted thereto. The stationary ring includes a cutout 38 shaped to slidably receive the pressure pad to that it can move in the cutout in a direction perpendicular to the faces of the stationary ring. One or more springs 40 anchored in bores 42 in the back plate bias the pressure pad toward drum wheel disk 14, thereby pressing coin 33 against the back side of the disk, as is best illustrated in FIG. 4, and stabilizing it. Pressure pad 32 may be in two or more parts, as shown in FIG. 7, or may be one solid plate, the choice depending on whether a staged coin exit is to be achieved or not.

The back side of drum wheel disk 14 includes a set of circularly arcuate, radially spaced-apart, rib-shaped coin pushers 44 which project into correspondingly shaped and arranged, circular, spaced-apart grooves 46 in stationary ring 36. A set of such pushers trails (in the direction of disk rotation) each coin receiving hole 17 in the disk to form a pocket for a coin which is recessed from hole 17. It is the function of the pushers to move any coin in space 28 through the space and toward stripper 20 as the disk is rotated while the coin is retained in the pocket.

Figure 6:
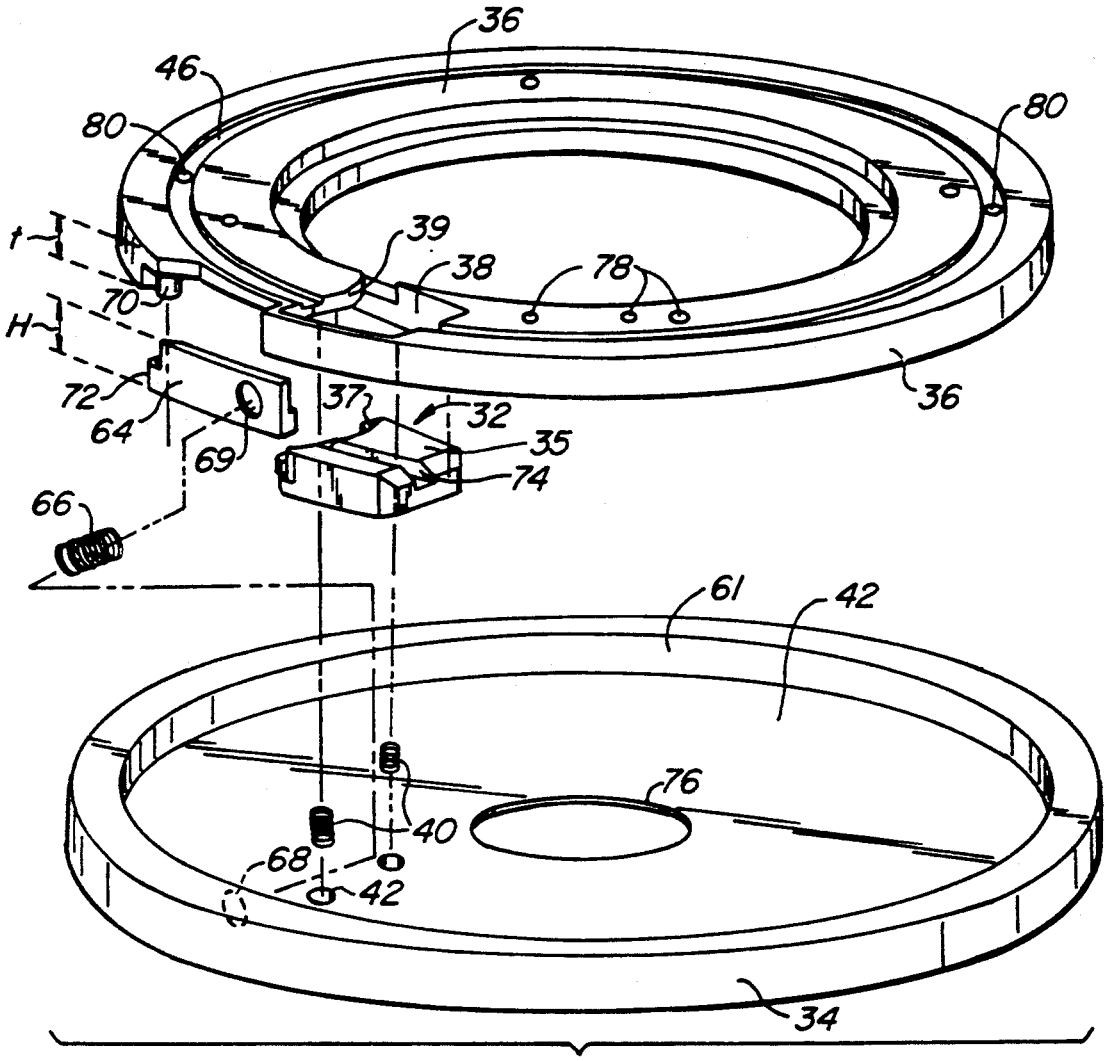
FIG. 6 shows an exploded perspective view of a second embodiment of the stationary back plate assembly, pressure pad, and coin guide.
Figure 5:
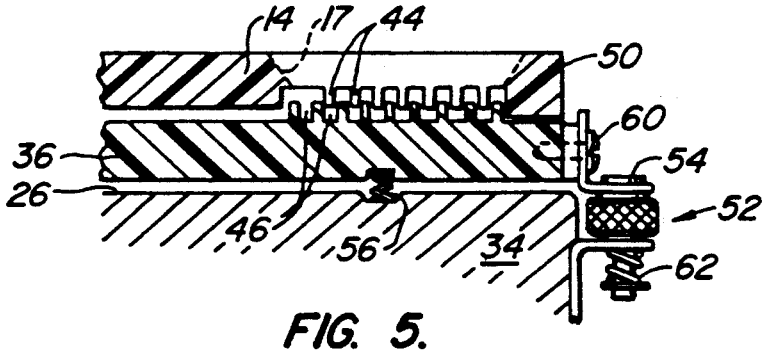
FIG. 5 is a section taken along line 5—5 of FIG. 3 showing an embodiment of an assembly allowing the adjustment of the separation between the stationary back plate assembly and the drum wheel disk.

As perhaps better seen in the section of FIG. 5, taken along the line 5—5 of FIG. 3, coin pushers 44 track in the stationary ring grooves 46 in stationary ring 36. Thus, as drum wheel disk 14 rotates as shown in FIG. 3, coins deposited in coin holes 17 and lodged in coin receiving space 28 will be moved toward pressure pad 32 by coin pushers 44. As the drum wheel disk is rotated in the counterclockwise fashion, the pushers exert a force on the coins which tends to move the coins tangentially toward the drum wheel disk periphery. Upstream of coin stripper 20 and pressure pad 32 and generally near the top of stationary ring 36 is a pivotally mounted coin guide 64, as shown in FIGS. 3, 4, and 6, which stabilizes and directs the coin in space 28 towards hub 48 before the coin encounters the pressure pad 32 and contacts coin stripping edge 24. Coin guide 64 in effect exerts a force which counteracts the tendency of the coin to move tangentially toward the periphery of the drum wheel disk.

Referring to FIGS. 3 and 4, as the coins approach coin stripper 20 they are stabilized by pressure pad 32. Pressure pad 32 is located strategically above, i.e., just upstream of coin stripping edge 24 and it gently presses the coin against the back side of the disk, thereby eliminating any play and looseness of the coin in the space and preventing a coin from gravitationally and uncontrollably dropping onto the coin stripping edge 24. Pressure pad 32 ensures the positive guidance of the coin and its controlled advance through space 28 as it is being pushed by pushers 44 of the rotating drum wheel disk.

The stripper edge 24 is defined by stripper ribs 25 (FIG. 3) on coin stripper 20 and they are spaced apart to accommodate coin pushers 44 on the back side of drum wheel disk 14. Once the coin contacts stripper edge 24 its motion is redirected by the edge while the pushers continue to apply a moving force to the coin to advance it transversely to the direction of rotation along the stripper edge and out of space 28 toward coin discharge area 30. As the coin moves along the stripper edge, the coin periphery is engaged by successively radially more outward pushers of the set. The geometry of the coin periphery, the stripper edge and the pushers of the set are such that the contact point between the coin periphery and the pushers remain in the general vicinity of the centerline of the coin which is parallel to the stripper edge 24. This minimizes the force component applied by the pushers to the coin which acts transverse, i.e. relatively perpendicular to the stripper edge.

The increasingly trailing position of the leading edges of the radially more outward pushers facilitates this reduction of the transverse force component. The small force which presses the coin against the stripper edge 24 minimizes wear and tear of the edge, the pushers, and the coins. It also reduces the generation of undesirable coin dust within the machine.

Referring now to FIG. 3, stationary ring 36 has the same number of spaced-apart grooves 46 as there are coin pushers 44 on drum wheel disk 14. Spaced-apart grooves 46 also serve the function of collecting "coin dust" which is generated by the coin mass as it tumbles in the coin bowl. Such "coin dust" typically includes metal shavings from coins, fibers, paper fragments and other assorted dirt and rubbed off particles which may be detrimental to the smooth operation of the coin handling machine. To remove the coin dust from the machine, stationary ring 36 preferably has one or more through-holes 80 at spaced apart locations in the grooves. Coin dust eventually accumulates in the grooves and is swept by the moving pushers 44 to the holes where it drops out of the machine.

Referring to FIG. 5, a modification of the apparatus allows the separation between stationary ring 36 and drum wheel disk 14 to be adjusted for handling coins of different thicknesses with the same machine. For this purpose an adjustable nut and screw assembly 52 is attached (e.g. welded) to back plate 34, having a main separation adjustment screw 54 and a spring 62. One or more adjusting springs 56 support stationary ring 36 in a firm but elastic manner on the back plate 34. A bolt and washer assembly 60 connects adjustable nut and screw assembly 52 to stationary ring 36. When main adjustment screw 54 is rotated clockwise by hand or with a suitable tool the separation between the back surface of drum wheel disk 14 and front surface of stationary ring 36 is decreased as the stationary ring moves axially toward the disk, with the opposite rotation of screw 54 effecting an increase in separation.

Referring now to FIG. 6, there is shown an exploded perspective view of the stationary back plate assembly, pressure pad, and coin guide. Coin guide 64 is pivotally mounted to the stationary ring 36 with a pivot defined by a pin 70 and a journal 72. A spring 66 which is anchored in bores 68, 69 in the back plate and the coin guide, respectively, biases coin guide 64 toward the center of ring 36.

Referring to FIGS. 4 and 6, an embodiment of pressure pad 32 is shown which is shaped to help position a coin properly relative to the stripper edge. The pressure pad includes a first surface 35 facing the drum wheel disk which is substantially parallel thereto, and a second surface 37 which is contiguous with and located in the direction of disk rotation upstream of the first surface 35. Second surface 37 slopes away from the disk in a direction opposite to the direction of disk rotation to facilitate the engagement of the coin by the pressure pad 32 as the coin is advanced toward the stripper edge 24. Springs 40 urge the pressure pad or pads through aperture 38 in ring 36 against the backside of disk 14 or, when a coin overlies the pad, against the coin, thereby urging the coin against the back side of the disk to stabilize it as it continues to move toward engagement with the stripper edge.

In addition to stabilizing the coins moving over the pressure pad, the pad, when no coin is present, rests flush against the back side of the disk and for that purpose it includes grooves which are shaped and positioned to correspond to the grooves in ring 36 so that the pushers on the back side of the disk can move therethrough. When the pad is flush against the back side of the disk, it prevents the entry of a fresh coin from the hopper into a coin opening 17 located upstream but in the vicinity of the stripper edge. If a coin were permitted to enter the opening at such a location, it might only partially enter space 28 between the disk and the back plate and remain partially in the opening, with one part of the coin in the space between the disk and the back plate and the other part on the hopper side of the disk. If the inner part of such a coin were permitted to contact the stripper edge, the coin would become wedged between the edge and the coin opening 17 in the disk. This would arrest the rotation of the disk and render the entire machine inoperative. Biasing the pressure pad 32 flush against the back side of the disk prevents such an occurrence.

FIG. 7 shows another embodiment of a pressure pad 32 comprising in two parts 32*a* and 32*b*. The advantage of having the configuration and number of pads as shown in FIG. 7 is that it may be shaped to extend a substantial length across the coin stripping edge 24 of coin stripper 20. This enhances the control over and guidance of the coin as it approaches and then moves along the stripper edge.

Figure 8:
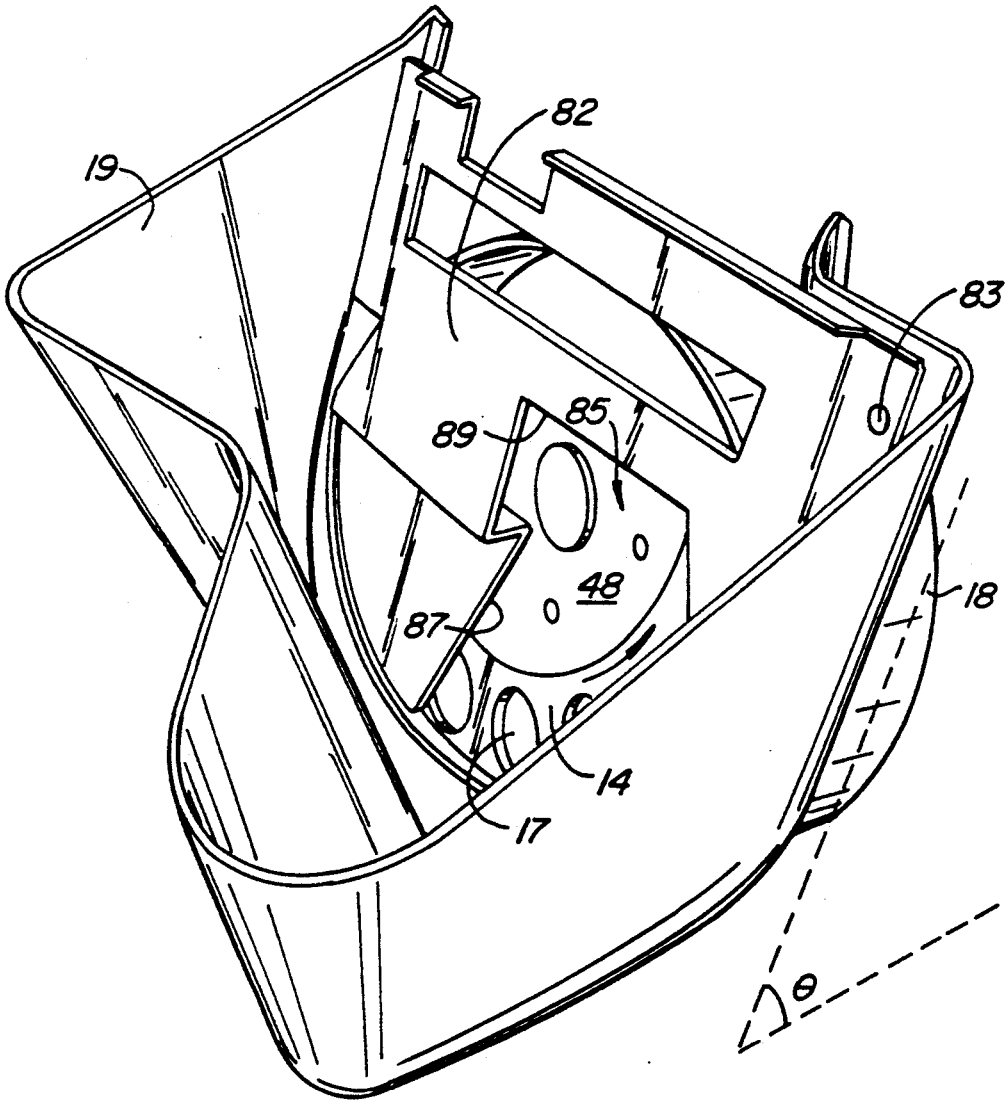
FIG. 8 shows a perspective view of the coin handling machine having a baffle plate useful for high coin levels, reducing the effective weight of the coin mass and thus the strain on the means for rotating the drum wheel disk.

Referring to FIG. 8, in another embodiment the hopper 19 of the coin handling machine of the present invention includes a baffle plate 82 attached (e.g., welded or bolted) to the inside of the hopper 19, e.g., at 83. The baffle plate covers a major portion of the side of disk 14 facing the interior of the hopper and includes a cutout 85, in the lower portion of the baffle plate, which is defined by an upright, generally vertical edge 87 and an upper, horizontal edge 89. The baffle plate prevents a substantial and, depending on the height of the coin mass, even a major part of the coins from contacting the rotating disk, thereby reducing wear and tear, friction and, surprisingly, facilitating the pickup of fresh coins in coin holes 17 of the disk. Coin lifters 91 (see FIG. 3) in the form of small blocks bolted to the periphery of disk 14 may be provided for agitating the coin mass overlying cutout 85 in the baffle plate to facilitate the positioning of coins in each coin opening 17 as it passes the cutout and moves towards coin stripper 20. The coin lifter has a height less than the spacing between the disk and baffle plate 82 to prevent any interference between them.

The hub, drum wheel disk, and cylindrical coin bowl may be made out of any material which can withstand the physical conditions existing in the hopper. Since the hopper will usually handle metal coins, materials of construction typically include various steels and steel alloys. Thermoplastics, such as TEFLON®, may also be used, as well as thermo-setting compression molded resins such as phenol-formaldehyde-type resins. Coin guide 64 can be fabricated using either metal or high-wear plastic. Preferably steel with a high surface hardness is used. Pressure pad 32 is preferably made of either metal or high-wear resistant plastic and may be fabricated by methods well known in the art, such as simple injection molding of a thermoplastic such as nylon or TEFLON ®.

Turning now to the operation of the coin handling machine of the present invention, and referring to the drawings, coins are initially placed inside hopper 19 and motor 10 is energized to rotate disk 14. As coin openings 17 sweep past cutout 85 in baffle plate 82, coins drop into coin opening 17 and become positioned in annular space 28 between the disk and the back plate 34. Pushers 44 advance the coins as the disk rotates towards stripper 20. The coins will typically move radially outward toward and frequently into engagement with skirt 50 of the disk which forms the peripheral boundary for annular space 28.

When a given coin reaches coin guide 64, in the typical, inclined installation of the machine shown in FIG. 2 at the top of the back plate, the spring loaded guide urges the coin radially inward toward and into engagement with hub 48. At this time the spring biased pressure pad 32 engages the side of the coin facing the back plate and urges the coin against the back side of the disk, thereby stabilizing it and preventing the coin from uncontrollably moving, e.g., gravitationally dropping downwardly onto stripper edge 24. Instead, the coin is moved by pushers 44 and once it engages the stripper edge, its direction of movement changes and its motion continues along the stripper edge until the coin is entirely outside the annular space 28 between the disk and the back plate and in coin discharge area 30 for further movement toward a payout location (not shown).

It has been surprisingly shown that the apparatus of the present invention not only reduces static friction within the rotating coin bowl and reduces failure due to static friction, but improves the flow of coins through the hopper, which is to a large extent due to the reduction of static friction between coins and stationary or slow moving parts of the hopper, and stabilization of the coins in the coin receiving space as they approach the coin stripper and exit the coin handling machine.

The features described herein in accordance with the invention can also be retrofitted into existing machines to improve coin flow and reduce hopper failures.

What is claimed is:

1. A coin handling machine for sequentially dispensing individual coins from a mass of coins, the machine comprising a frame, a stationary back plate assembly mounted to the frame and having a face which is angularly inclined relative to the vertical, a rotatable disk parallel to and spaced from the stationary back plate assembly for defining a generally annular coin moving space between the disk and the stationary back plate assembly, the disk including a plurality of circumferentially spaced coin holes of a diameter sufficient to permit passage of a coin from a side of the disk facing away from the stationary back plate assembly into the coin moving space, a set of coin pushers associated with each coin hole, the pushers being radially spaced, and the stationary back plate assembly including a plurality of spaced-apart circular grooves positioned and formed to coincide with the positions of the pushers, the pushers extending from the disk into the associated grooves, the pushers of each set trailing their associated coin hole in the disk, whereby the pushers form a pocket for the coins in the space and move coins along an arcuate path through the space as the disk is rotated, and stripper means traversing the arcuate path for intercepting the coins and thereafter moving them from the space to a coin discharge area which is beyond a periphery of the disk, and a pressure pad located proximate to and upstream of the stripper means with respect to the direction of disk rotation, the pressure pad being movably mounted to the stationary back plate assembly, and including means for biasing the pressure pad toward the disk for (1) pressing a coin overlying the pad against the disk, to thereby stabilize the coin in the space immediately prior to its engagement by the stripper means, and (2) causing the pad to engage the disk when there is no coin overlying the pad, to thereby prevent the entry of a coin through one of the coin holes located just upstream of the stripper means.

2. A coin handling machine according to claim 1 wherein the radially innermost pusher of each set is closest to the respective associated coin hole in the disk and the radially outermost pusher is further removed from the respective associated coin hole in the disk so that the forces applied by the pushers of each set to a coin engaged by the stripper means act generally in the direction of the movement of the coin to the discharge area.

3. A coin handling apparatus according to claim 1 wherein, with respect to the direction of disk rotation, the leading edge of each pusher of a given set, except the pusher closet to the center of the disk, trails the leading edge of an adjacent pusher of the given set, the adjacent pusher being closer to the center of the disk, coin hole to facilitate the removal of the coin from the space by the stripper means.

4. A coin handling machine according to claim 1 wherein the pressure pad is shaped and positioned to bias the coin against the disk before the coin engages the stripper means.

5. A coin handling machine according to claim 1 including a coin guide movably mounted to the periphery of the back plate at a position upstream of the stripper means and upstream of the pressure pad, the coin guide including means for biasing the coin guide radially toward the center of the disk to thereby bias a coin impinging on the guide into the space.

6. A coin handling machine according to claim 1 wherein the stationary back plate assembly comprises a stationary ring and a stationary back plate, the stationary ring positioned between the disk and stationary back plate, including means for adjusting the space between the disk and the stationary ring, said adjusting means comprising an adjustable nut and screw assembly attached to the stationary back plate and a bolt and washer assembly connecting the adjustable nut and screw assembly to the stationary ring, whereby as the adjustable nut and screw assembly is rotated the space between the disk and stationary ring is increased or decreased as desire

7. A coin handling machine according to claim 1 further a fixed coin hopper attached to the frame and a fixed plate fastened internally to the hopper extending a substantial portion of the cross-sectional area of the hopper, whereby a coin mass having a level substantially above the baffle plate is partially supported by the baffle plate.

8. A coin handling machine for serially dispensing coins from a mass of coins, the machine comprising:

a frame and a back plate mounted thereto so that the plate is angularly inclined relative to a vertical plane, the back plate including a plurality of radially spaced, concentric open grooves;

a disk overlying the back plate and spaced therefrom to form a coin moving space between the disk and the plate, the disk including a plurality of coin receiving holes circumferentially spaced about the disk and sized to permit passage of the coins into the moving space;

a side of the disk facing the plate including a set of radially spaced-apart pushers for each coin hole, the pushers extending into corresponding grooves of the back plate and having leading edges facing in the direction of rotation of the disk, wherein, with respect to the direction of disk rotation, the leading edges of the pushers of each set, except the pusher closest to the center of the disk, trail the leading edges of the adjacent, radially-more-inward pushers of each set;

means for rotating the disk;

a coin-stripper secured to the back plate and defining a coin stripping edge which edge extends into the coin moving space and traverses the grooves in the back plate, the stripper forming grooves which coincide with the grooves in the plate to permit the passage of the pushers on the disk past the edge, whereby upon the rotation of the disk with a coin in the coin moving space, one of the pusher sets of the disk advances the coin through the space until the coin contacts the coin stripping edge and the edge then guides the coin out of the space toward a coin discharge area by engaging the coin in contact with the edge with sequential, increasingly radially outwardly located pushers so that the force applied to the coin by the pushers of the rotating disk is oriented generally in the direction substantially parallel to the edge to minimize wear of the pushers and the edge.

9. A coin handling machine according to claim 8 wherein the pushers of each set trail their coin hole in the disk in the direction of disk rotation so that, when a coin in the space is engaged by a pusher of the set, the coin is offset relative to the coin hole of the set.

10. A coin handling machine for sequentially discharging individual coins from a mass of coins comprising:

a frame;

a back plate mounted to the frame;

a rotatable disk overlying the back plate and spaced therefrom to define a coin moving space between the disk and the back plate, the disk including a plurality of pushers extending from the disk into the coin moving space for engaging coins disposed in the space and moving them along an arcuate path through the space as the disk rotates;

means for rotating the disk;

a stripper disposed in the space for intercepting coins moving along the arcuate path and directing such coins out of the space toward a coin discharge area;

a pressure pad positioned upstream of and proximate to the stripper and mounted to the back plate for relative movements from the back plate toward the disk and into the coin moving space; and means for biasing the pressure pad toward and into engagement with the disk so that a coin advancing through the space is engaged and pressed against the disk by the pressure pad to thereby stabilize the coin just prior to and while it is engaged by the stripper and directed out of the space by the pushers.

11. A coin handling machine according to claim 10 wherein the pressure pad includes a first surface facing the disk and substantially parallel thereto, and a second surface contiguous with and in the direction of disk rotation upstream of the first surface, the second surface sloping away from the disk in a direction opposite to the direction of disk rotation to facilitate the engagement of the coin by the pressure pad as the coin advances toward the stripper.

12. An improved coin handling machine of the type having a frame, a fixed coin hopper attached to the frame having an internal surface defining a coin storage volume, a rotating coin bowl within the hopper, the coin bowl including a bottom drum wheel disk, the drum wheel disk having front and back surfaces, the front surface defining the coin bowl bottom, the drum wheel disk having a plurality of coin holes about its outer periphery, a coin bowl cylinder extending perpendicular to said front surface, and a hub attached to the drum wheel disk in a plane substantially parallel to the drum wheel disk, a stationary back plate spaced from and facing the back surface of the drum wheel disk and defining an annular space therebetween through which coins can be moved, the stationary back plate having a coin stripper for discharging coins from the space and a plurality of radially spaced grooves;

the back surface of the drum wheel disk having a plurality of radially spaced coin pushers extending into said grooves, a set of pushers being provided for and trailing each coin hole;

means for adjusting the spacing between the back surface and a stationary ring for accommodating coins of varying thickness;

the coin stripper having a plurality of stripper ribs which define a coin stripping edge and grooves arranged to permit the pushers to pass the stripper edge as the drum wheel disk rotates, whereby coins are directed out of the space by the combined action of the pushers and the stripper edge which causes a coin engaged by the edge to move therealong toward a coin discharge area beyond a periphery of the coin bowl, and a pressure pad located proximate to and upstream of the stripper with respect to the direction of disk rotation, the pressure pad being movably mounted to the back plate, and including means for biasing the pressure pad toward the disk for (1) pressing a coin overlying the pad against the disk, to thereby stabilize the coin in the space immediately prior to its engagement by the stripper, and (2) causing the pad to engage the disk when there is no coin overlying the pad, to thereby prevent the entry of a coin through one of the coin holes located just upstream of the stripper.

13. Apparatus in accordance with claim 12 wherein each pusher has a leading edge rounded to reduce the force component on a coin perpendicular to the stripper edge and increase the force component on a coin parallel to the stripper edge.

14. Apparatus in accordance with claim 12 wherein the pressure pad is positioned in a recess of the back plate and has grooves corresponding to and aligned with the back slate grooves.

15. Apparatus in accordance with claim 14 wherein the pressure pad comprises a plurality of pressure pad portions.

16. Apparatus in accordance with claim 12 wherein the fixed hopper includes a baffle plate fastened to the hopper, spaced from and extending partially across the disk, whereby some of the coins in the hopper are supported by the baffle plate prior to the coins being accepted by the drum wheel disk.

17. Apparatus in accordance with claim 12 wherein the stationary back plate is attached to the frame and the stationary ring is positioned between the back surface of the disk and the stationary back plate, and wherein said means for adjusting the spacing between the back surface of the disk and the stationary ring includes an adjustable nut and screw assembly attached to the stationary back plate and a bolt and washer assembly connecting the adjustable nut and screw assembly to the stationary ring, whereby as the adjustable nut and screw assembly is rotated the separation between disk and stationary ring is increased or decreased as desired.

* * * * *